US008205751B2

(12) United States Patent
Mezzini

(10) Patent No.: US 8,205,751 B2
(45) Date of Patent: Jun. 26, 2012

(54) FOLDING PACKET

(75) Inventor: Sergio Mezzini, Pianoro (IT)

(73) Assignee: GIMA S.p.A., Bologna (IT)

( * ) Notice: Subject to any disclaimer, the term of this patent is extended or adjusted under 35 U.S.C. 154(b) by 0 days.

(21) Appl. No.: 12/866,629

(22) PCT Filed: Feb. 10, 2009

(86) PCT No.: PCT/IB2009/000267

§ 371 (c)(1),
(2), (4) Date: Sep. 3, 2010

(87) PCT Pub. No.: WO2009/101524

PCT Pub. Date: Aug. 20, 2009

(65) Prior Publication Data

US 2011/0180444 A1 Jul. 28, 2011

(30) Foreign Application Priority Data

Feb. 11, 2008 (IT) ..... BO2008A0085

(51) Int. Cl.
*B65D 85/00* (2006.01)

(52) U.S. Cl. ..... 206/526; 206/37; 206/538

(58) Field of Classification Search ..... 206/800, 206/37, 273, 261, 472, 461, 526, 538, 232, 206/528; 229/87.07, 120.011; 426/108
See application file for complete search history.

(56) References Cited

U.S. PATENT DOCUMENTS

| | | | | |
|---|---|---|---|---|
| 4,294,353 | A * | 10/1981 | Focke et al. | 206/273 |
| 5,885,630 | A * | 3/1999 | Zurawski et al. | 426/5 |
| 6,837,369 | B2 * | 1/2005 | Amos | 206/273 |
| 6,941,728 | B1 * | 9/2005 | Bray et al. | 53/449 |
| 7,155,882 | B2 * | 1/2007 | Ghini et al. | 53/444 |
| 7,159,717 | B2 * | 1/2007 | Aldridge et al. | 206/449 |
| 7,347,033 | B2 * | 3/2008 | Gamberini et al. | 53/444 |
| 7,811,614 | B2 * | 10/2010 | Aldridge | 426/108 |
| 7,901,719 | B2 * | 3/2011 | Aldridge | 426/115 |
| 2002/0020640 | A1 * | 2/2002 | Garcia | 206/246 |
| 2005/0035023 | A1 * | 2/2005 | Breu et al. | 206/531 |
| 2005/0269233 | A1 * | 12/2005 | Aldridge | 206/472 |

FOREIGN PATENT DOCUMENTS

| | | |
|---|---|---|
| FR | 2614720 | 11/1988 |
| GB | 2385841 | 9/2003 |
| WO | 8808602 | 4/1988 |
| WO | 2005110885 | 11/2005 |

OTHER PUBLICATIONS

International Search Report, dated Sep. 17, 2009, in PCT application.

* cited by examiner

*Primary Examiner* — Steven A. Reynolds
(74) *Attorney, Agent, or Firm* — Young & Thompson

(57) ABSTRACT

This invention relates to a packet for containing products and designed to display the products in a manner especially convenient for them to be picked by the user.

14 Claims, 5 Drawing Sheets

FOLDING PACKET

TECHNICAL FIELD

This invention relates to a packet for containing products, in particular products in pieces such as chewing gum sticks, bars of chocolate, flow packs, phials, blister packs.

BACKGROUND ART

Packets for chewing gum sticks are known, which comprise a cardboard box for containing the sticks. The sticks are placed side by side along the longer, thinner edge to form a group. The packet contains two groups which, when the packet is fully open, lie in substantially the same plane and are aligned at right angles to the line along which the sticks are placed side by side within the groups.

Since the sticks are also taken out of the packet along that line, that is, at right angles to the line along which they are placed side by side, picking a stick from one of the two groups is more awkward when the other group placed alongside it is present.

Also known are packets containing two groups of sticks placed side by side which, when the packet is opened, are superposed, that s to say, placed side by side along the surface delimited by the length and major width of the sticks.

In this solution, the products belonging to the group under the first group are not fully visible and are therefore less easy to take out of the packet.

DISCLOSURE OF THE INVENTION

This invention therefore provides a packet containing at least two groups of products, characterized in that the groups of products are positioned on surfaces of the packet that can be turned relative to each other.

In particular, the surfaces rotate about an axis of rotation parallel to the principal axis of the products or parallel to the direction in which the products are taken out of the packet.

In a packet of this kind, once opened, the groups of products are fully visible and arranged in a line parallel to the direction in which they are taken out of the packet, thus making it easy to take out any product from any group since the groups are substantially aligned in a single row.

BRIEF DESCRIPTION OF THE DRAWINGS

These and other characteristics of the invention may be clearly inferred from the preferred embodiments described below purely by way of example and without limiting the scope of protection.

DETAILED DESCRIPTION OF THE PREFERRED EMBODIMENTS OF THE INVENTION

Figure 1:
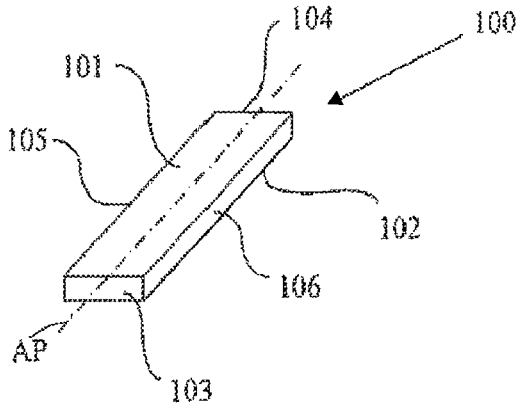
FIG. 1 illustrates a product in the form of a chewing gum stick.

FIG. 1 shows a stick of chewing gum 100.

The stick has two main faces 101 and 102, larger in size than all the others, two faces 103 and 104, referred to as end faces, smaller in size than all the others, and two lateral faces 105 and 106, referred to as long edges.

The principal axis of the chewing gum stick is the axis AP through the two centres of gravity of the end faces 103 and 104.

The thickness of the chewing gum stick is the smallest dimension of the stick.

Figure 2:
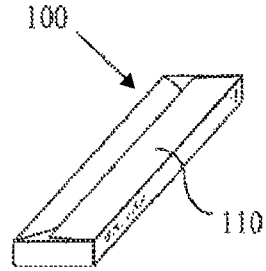
FIG. 2 illustrates the chewing gum stick wrapped according to a first wrapping style.

In one particular embodiment, shown in FIG. 2, the chewing gum stick is wrapped in a primary wrapping 110.

This wrapping may be a sheet folded around the stick or a sheet folded and sealed around the stick.

The primary wrapping may be made of paper, paraffin paper, plastic, metallic foil or any combination of these materials.

Figure 3:
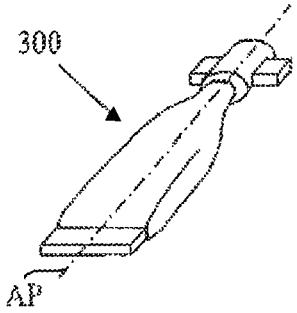
FIG. 3 illustrates a second product in the form of a phial.

FIG. 3 shows a phial 300, normally made of plastic.

The principal axis of the phial is the axis AP through the two centres of gravity of the bottom and cap of the phial.

Figure 4:
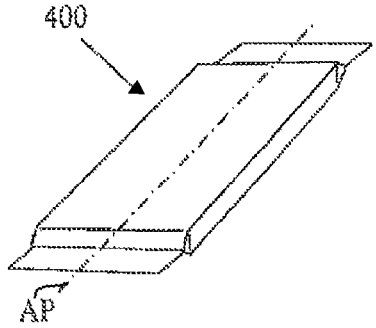
FIG. 4 illustrates a third product in the form of a flow pack.

FIG. 4 shows a flow pack 400, normally made of paper, paraffin paper, plastic or metallic foil or any combination of these materials. The flow pack may be sealed on three or four sides, as is well known in the trade.

The principal axis of the flow pack is the axis AP through the centre of the two seals furthest away from each other on the flow pack.

In the first preferred embodiment of it, the packet according to the invention contains two groups of chewing gum sticks.

Figure 5:
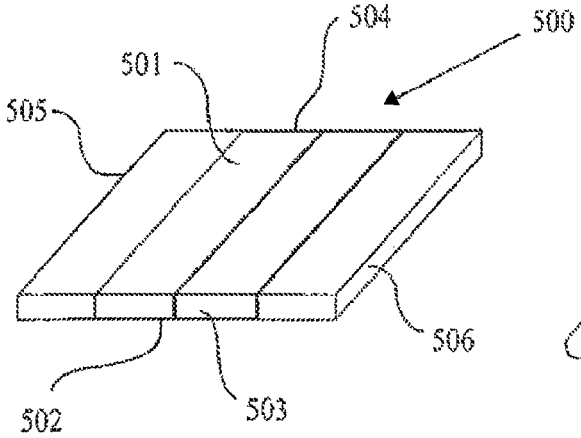
FIG. 5 illustrates a first group of products in the form of sticks placed side by side.

Each group of sticks 500 is composed of at least two sticks 100 placed side by side along the respective long edges, as shown in FIG. 5.

The main top face 501 of the group and the main bottom face of the 502 of the group are defined by the two faces of the group 500 coinciding with the set of the main faces 101, 102 of the sticks it is composed of, the end faces 503 and 504 of the group by the two faces coinciding with the set of the end faces 103 and 104 of the sticks it is composed of, and the lateral faces 505 and 506 of the group are the remaining two faces.

The thickness of the group of chewing gum sticks is the smallest dimension of the group of sticks.

In one particular embodiment of the packet, the group 500 of sticks placed side by side is retained by a sheet, which forms a secondary wrapping. In a first preferred embodiment of it, known in the trade, the sheet is in the form of a pocket which covers the group of chewing gum sticks on 5 sides.

In a second preferred embodiment, not illustrated, the wrapping sheet is in the form of a sleeve which covers the group on 4 sides. In other preferred embodiments not illustrated, the wrapping sheet may be placed round 2 or 3 sides of the wrapped product or it may be attached to only one face of the group. In yet another preferred embodiment. not illustrated, the wrapping sheet covers the group completely. The wrapping sheet may be made of paper, paraffin paper, metallic foil, plastic or any combination of these materials.

Figure 6:
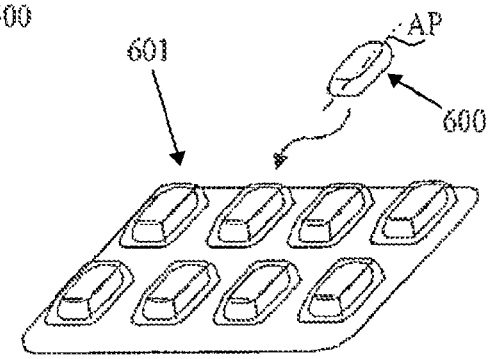
FIG. 6 illustrates a second group of products in the form of pills contained in a blister pack.

FIG. 6 shows a second type of product group 601, consisting of pills 600 contained in a blister pack. The principal axis of the product 600 is the axis AP joining the centres of gravity of the two opposite surfaces furthest away from each other.

Generally speaking, the axis AP is the major axis of symmetry of the product.

Figure 7:
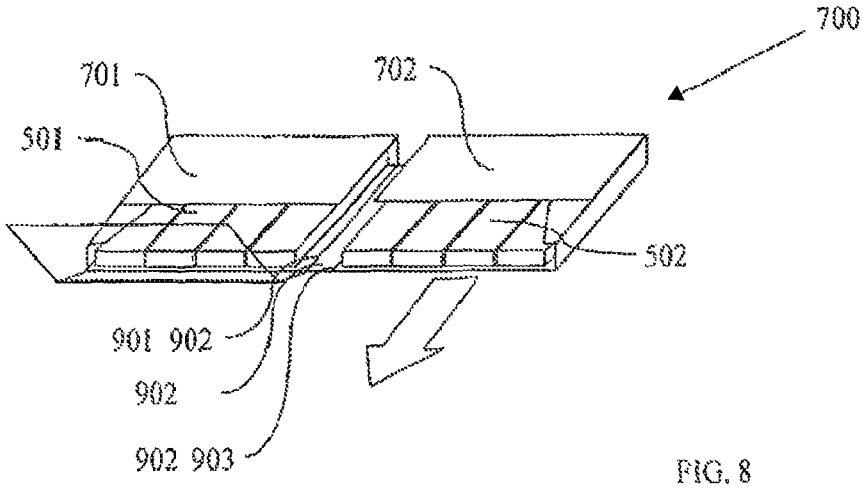
FIG. 7 illustrates a first preferred embodiment of the packet in a fully opened condition.

FIG. 7 shows the first preferred embodiment of the packet 700 in the fully open condition, that is to say, in the condition where the sticks can be taken out and the two groups lie in parallel planes.

The packet comprises two compartments 701 and 702, each containing a group of products 501 and 502. The compartments can be rotated relative to each other using the two crease or weakening lines 901 902 and 902 903 which delimit the bottom connecting wall 902 as a hinge.

The two compartments contain the two groups of sticks in such a way that the respective end faces of each group are aligned, that is to say, in such a way that the respective end faces of the groups of sticks lie in the same plane.

Figure 8:
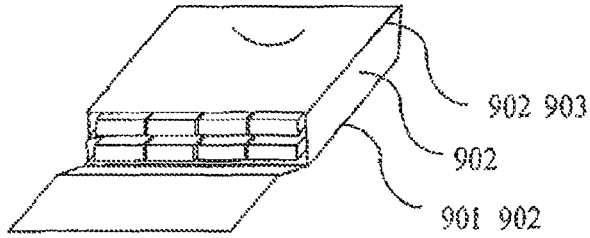
FIG. 8 illustrates a first preferred embodiment of the packet with the lid open.

This makes it possible to obtain a closed packet, illustrated in FIG. 8 with the lid open so as to show more clearly the arrangement of the products in the compartments, where the two groups of sticks are substantially superposed over one another, with the main top face of the first group being face to face with the main bottom face of the second group.

Using the hinge constituted by the bottom connecting wall, the user can simply pass from the closed configuration of FIG. 8, where the sticks are protected, to the open configuration of FIG. 7, where the sticks are completely accessible.

Each compartment covers the respective group of products on 4 sides, respectively at the main top face of the group, the main bottom face of the group, one of the two end faces of the group and one of the two lateral faces of the group.

In one particular embodiment, the panels 921 and 923 of the packet at the top faces of the group are smaller in size than the faces themselves or are conveniently shaped to make it easier for the user to pick a chewing gum stick, which can be removed in a direction substantially coinciding with its main axis AP, on the side corresponding to the group's end face that is not covered once the packet is opened, as indicated by the arrow in FIG. 7.

According to advantageous aspects, the packet is equipped with a lid that can be turned about a line at right angles to the hinge for rotating the compartments.

According to further advantageous aspects, the packet can be made with a single piece of material. The material may be paperboard, paper, plastic, foil or any combination of these or equivalent materials.

Figure 9:
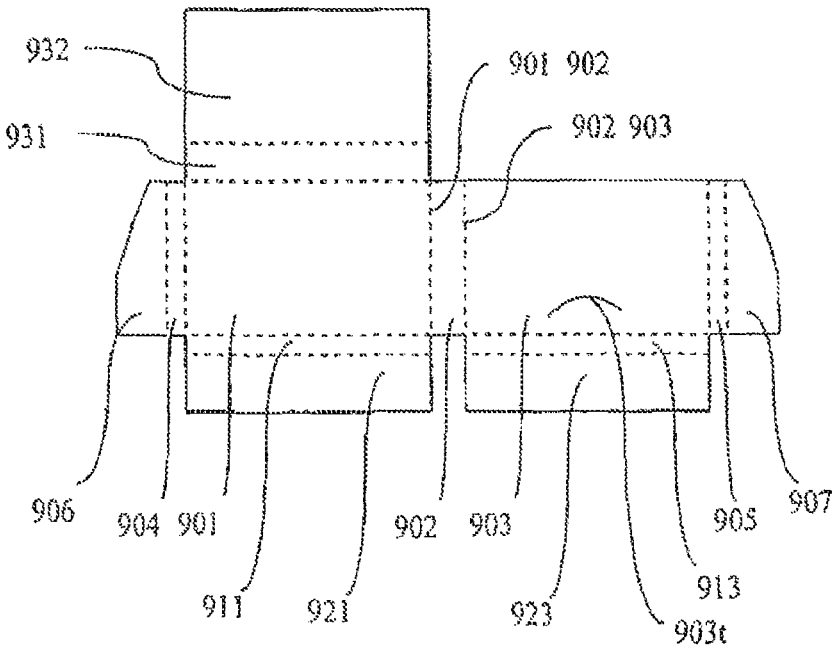
FIG. 9 is a plan view of the blank used to make the first preferred embodiment of the packet.

FIG. 9 shows a first preferred embodiment of a single blank used to make the packet just described. This blank comprises a primary bottom panel 901, a secondary bottom panel 903 and a connecting bottom panel 902 joined to the two panels 901 and 903 by respective crease or weakening lines 901 902 and 902 903.

Also provided are two bottom containment panels 911 and 913 which extend, respectively, from the panels 901 and 903, along the bottom side perpendicular to the lines 901 902 and 902 903.

Two corresponding front bottom containment panels 921 and 923 also extend from the panels 911 and 913 on the side opposite the connection to the panels 901 and 903.

The blank also includes two lateral containment panels 904 and 905 which extend from the free edges of the respective panels 901 and 903 opposite the lines 901 902 and 902 903 and two front lateral containment panels 906 and 907 which in turn extend from the corresponding panels 904 and 905 on the side opposite the connection to the panels 901 and 903. The blank is completed by another pair of panels 931, 932 which extend from the free upper end of the panel 901 and form the panels for closing the top and the front of the packet, respectively.

The front lateral containment panels 906 and 907, like the front bottom containment panels 921 and 923, as well as the front closing panel 932, may have any polygonal shape or may be delimited by a series of arcs and straight lines.

In order to make the packet shown in FIG. 5, the blank 90 is suitably folded along the crease or weakening lines which join the various panels, in such a way that the front lateral containment panels 906, 907 are positioned under the front bottom containment panels 921, 923.

Adhesion means are also provided between the inside of the panels 921, 923 and the outside of the panels 906, 907 in such a way as to form two compartments for containing the two groups of products. The adhesion means may be, for example, in the form of a cold glue, a hot-melt glues or a pressure adhesive.

When the packet is closed, the product is totally protected by the bottom containment panels, the lateral containment panels and the closing panel.

In a second embodiment that is not illustrated, the panels 906 and 907 are folded in such a way that they are positioned above the front bottom containment panels 921 and 923. In this case, the adhesion means are provided between the outside of the panels 921, 923 and the inside of the panels 906, 907.

According to particular aspects, which experts in the trade are familiar with, retaining means may be provided to hold the group of sticks within each compartment.

Means are also provided for fastening the front covering panel 932 to the secondary bottom panel 903, these means being embodied by a slit **903*t* cut in the panel 903** itself. These means enable the packet to remain closed after the second compartment has been folded onto the first and the lid closed.

Figure 10:
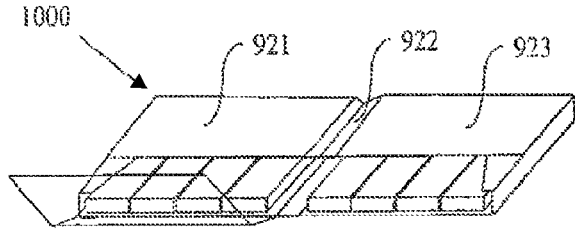
FIG. 10 illustrates a second preferred embodiment of the packet.
Figure 11:
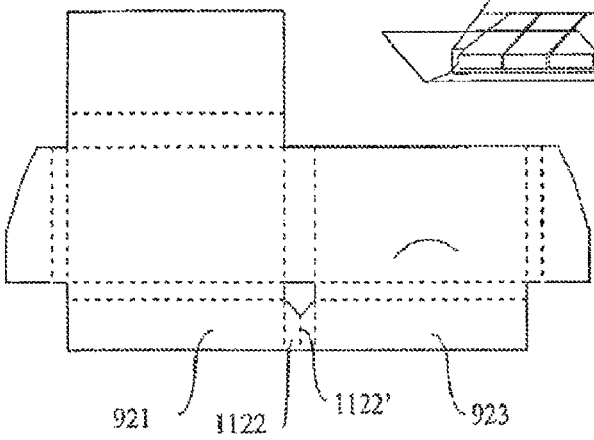
FIG. 11 is a plan view of the blank used to make the second preferred embodiment of the packet.

FIG. 10 shows a second preferred embodiment 1000 of the packet and FIG. 11, the blank used to make it. Both are very similar to the first embodiment and only the elements that distinguish it from the latter are described.

In this embodiment, the front bottom panels 921 and 923 are joined by a front bottom connecting panel 1122 that has a weakening line 1122' at the centre of it.

The open packet thus has only one compartment which can contain both groups of products, separated from each other, and positioned at the primary bottom panel 901 and secondary bottom panel 903, respectively.

In a third preferred embodiment 1700, the packet is made by joining two compartments, each obtained from a separate blank.

Figure 12:
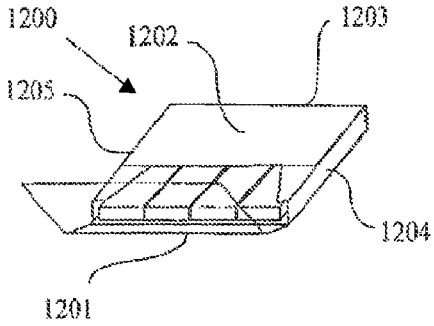
FIG. 12 illustrates a first partial packet.
Figure 13:
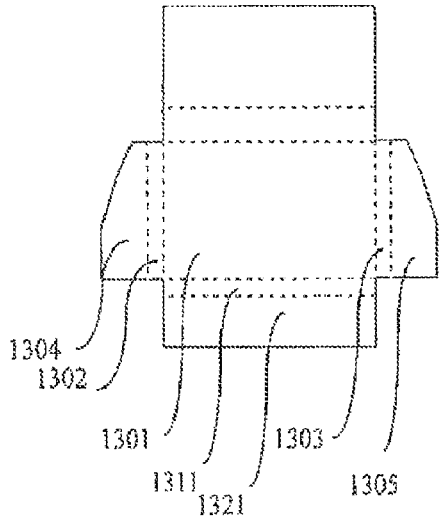
FIG. 13 is a plan view of the blank used to make the partial packet of FIG. 12.

FIG. 12 shows the first compartment 1200, made from the blank illustrated in FIG. 13 according to methods known to experts in the trade.

The first compartment 1200 has a plurality of walls, namely, a rear wall 1201, a front wall 1202, a bottom wall 1203 and two side walls 1204 and 1205.

With reference to the blank of FIG. 13, the bottom panel 1301 forms the rear wall 1201, the bottom containment panel 1311 the bottom wall 1203, the front bottom containment panel 1321, connected by suitable adhesion means to the front lateral containment panels 1304 and 1305, the front wall 1202 and the two lateral containment panels 1302 and 1303 the two side walls 1204 and 1205.

Figure 14:
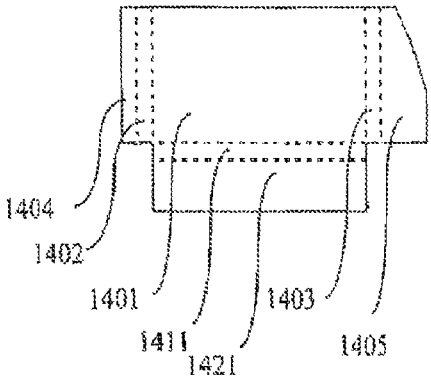
FIG. 14 is a plan view of the blank used to make a second partial packet.
Figure 15:
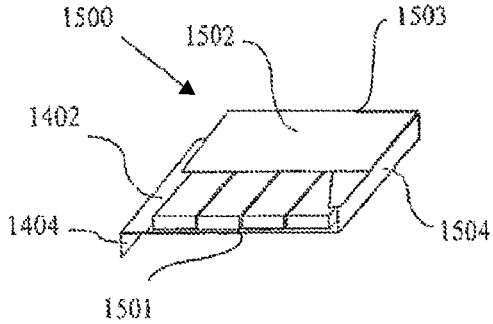
FIG. 15 illustrates a second partial packet.

The second compartment 1500 is shown in FIG. 15, while FIG. 14 shows the blank used to make it.

In this case, the rear wall 1501 is formed by the bottom panel 1401, the bottom wall 1503 by the bottom containment panel 1411, the front wall 1502 by the front bottom containment panel 1421 and the front lateral containment panel 1405, suitably connected to each other, and the side wall 1504 by the lateral containment panel 1403. The second compartment has a flap extending from the rear wall 1501, composed of two panels 1402 and 1404. In an especially preferred embodiment, the width of the panel 1402, minus the width of the paperboard, substantially coincides with the thickness of the group of products.

Figure 16:
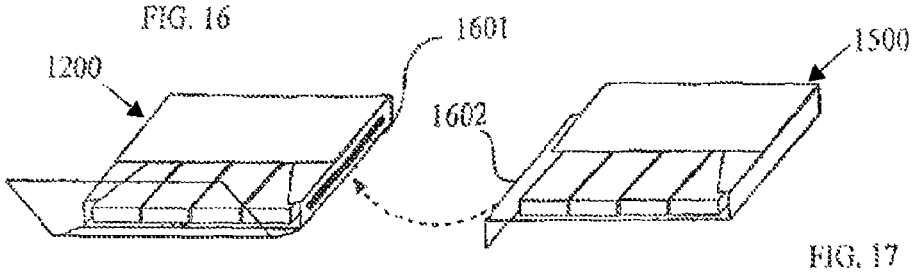
FIG. 16 illustrates the method of connecting the first and second partial packets.
Figure 17:
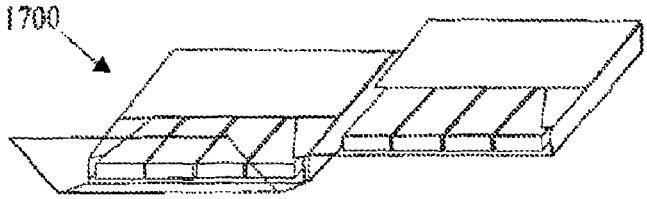
FIG. 17 illustrates the third preferred embodiment of the packet.

The third embodiment 1700 of the packet is obtained, as shown in FIG. 16, by connecting the two compartments 1200 and 1500 using suitable adhesion means 1601, 1602, applied between the inside of the panel 1404 and the side wall 1204 of the first compartment 1200.

The adhesion means may be embodied by cold glue, hot-melt glue or pressure adhesive.

Figure 21:
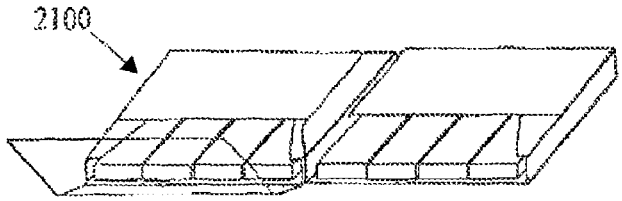
FIG. 21 illustrates the fourth preferred embodiment of the packet.
Figure 22:
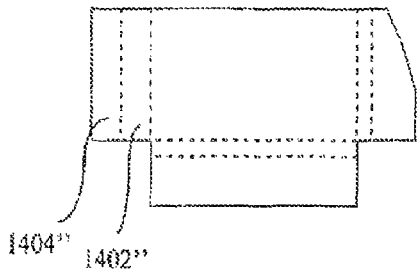
FIG. 22 is a plan view of the blank used to make a fourth partial packet.
Figure 23:
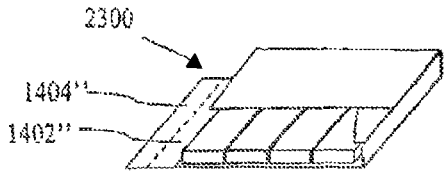
FIG. 23 illustrates a fourth partial packet.

The fourth preferred embodiment 2100 of the packet is illustrated in FIG. 21.

Figure 20:
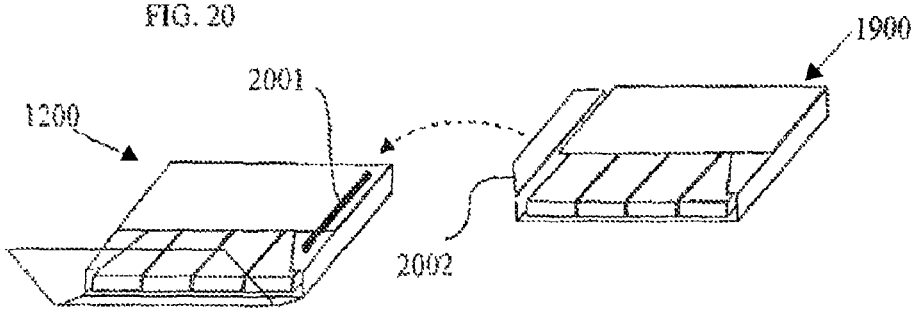
FIG. 20 illustrates the method of connecting the first and third partial packets.

In this case, too, the packet is obtained, as shown in FIG. 20, by connecting the two compartments 1200 and 1900 using suitable adhesion means 2001, 2002 applied between the outside of the panel 1404' and the front wall 1202 of the first compartment 1200.

The adhesion means may be embodied by cold glue, hot-melt glue or pressure adhesive.

Figure 18:
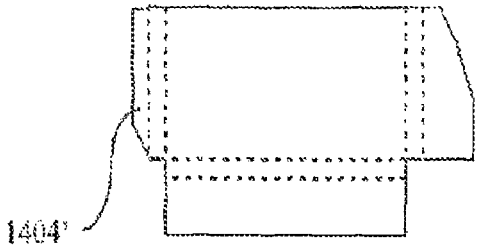
FIG. 18 is a plan view of the blank used to make a third partial packet.
Figure 19:
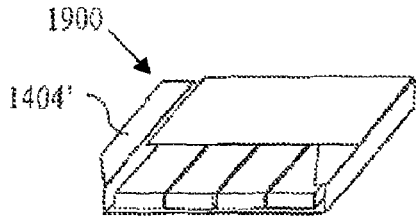
FIG. 19 illustrates a third partial packet.

The compartment 1900 is almost identical to the compartment 1500, and the blank used to make it, shown in FIG. 18 is almost identical to that of FIG. 14, except that the panel 1404', corresponding to the panel 1404, is suitably shaped so as not to interfere with the part of the front wall 1202 where the product is taken out of the compartment.

Figure 25:
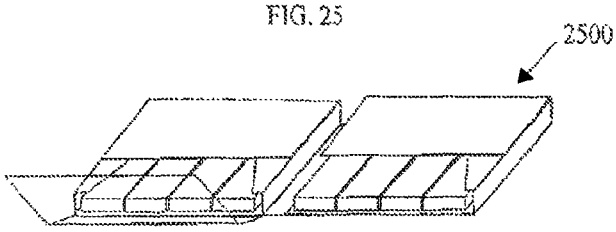
FIG. 25 illustrates the fifth preferred embodiment of the packet.

The fifth preferred embodiment 2500 of the packet is illustrated in FIG. 25.

Figure 24:
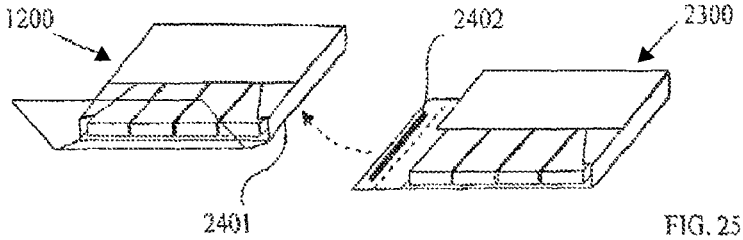
FIG. 24 illustrates the method of connecting the first and fourth partial packets.

In this case, too, the packet is obtained, as shown in FIG. 24, by connecting the two compartments 1200 and 2300 using suitable adhesion means 2401, 2402 applied between the inside of the panel 1404" and the rear wall 1201 of the first compartment 1200.

The adhesion means may be embodied by cold glue, hot-melt glue or pressure adhesive.

Figure 26:
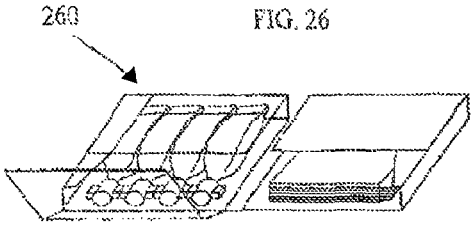
FIG. 26 illustrates the first preferred embodiment of the packet containing a group of phials and an instruction booklet.
Figure 27:
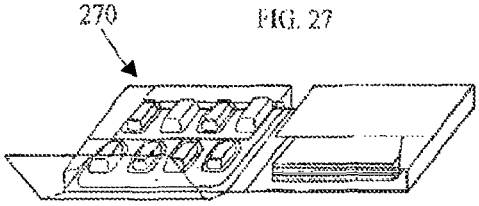
FIG. 27 illustrates the first preferred embodiment of the packet containing a blister pack and an instruction booklet.
Figure 28:
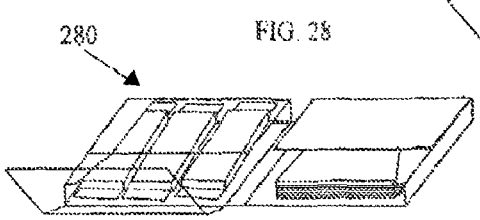
FIG. 28 illustrates the first preferred embodiment of the packet containing a group of flow packs and an instruction booklet.

The compartment 2300 is almost identical to the compartment 1500, and the blank used to make it, shown in FIG. 18 is almost identical to that of FIG. 14, except that the size of the panel 1402", corresponding to the panel 1402 is substantially twice the thickness of the product. FIGS. 26, 27 and 28 show a few examples of different products that can be placed in the packet of FIG. 7.

The invention thus provides a packet that well protects the groups of products when it is closed but fully displays them so they can be picked easily when it is opened. This is possible because the packet allows the groups of products it contains to be turned about an axis parallel to the direction in which the products are taken out of the packet. After turning them in this way, all the products are substantially aligned.

Moreover, all the embodiments of the packet according to the invention are easy to make by machine and require limited amounts of material, with obvious advantages in terms of reduced production costs.

The packets illustrated herein are used for descriptive purposes only without limiting the field of application of the invention.

Modifications and extensions may be developed on the basis of the teachings hereof and of the current state of the art and such modifications and extensions are deemed to be within the scope of this present invention.

The invention claimed is:

1. A packet comprising:

at least two compartments, each for containing a relative group of products having a principal axis, defining a direction of insertion and extraction of said groups of products into and from said two compartments, and a main top face, wherein a first compartment of said two compartments consists of four panels:

a primary bottom panel, a first lateral and external containment panel perpendicular to said primary bottom panel, a first bottom containment panel perpendicular to said primary bottom panel and to said first lateral and external containment panel, and a first front containment panel parallel to said primary bottom panel and perpendicular to said first lateral and external containment panel and to said first bottom containment panel, whereby said first front containment panel is connected to said primary bottom panel only by said first lateral and external containment panel and by said first bottom containment panel, wherein a second compartment of said two compartments consists of four panels:

a secondary bottom panel, a second lateral and external containment panel perpendicular to said secondary bottom panel, a second bottom containment panel perpendicular to said secondary bottom panel and to said second lateral and external containment panel, and a second front containment panel parallel to said secondary bottom panel and perpendicular to said second lateral and external containment panel and to said second bottom containment panel, whereby said second front containment panel is connected to said secondary bottom panel only by said second lateral and external containment panel and by said second bottom containment panel, wherein said two compartments are connected by a bottom connecting wall joined to said primary bottom panel and to said secondary bottom panel along two respective one of creases and weakening lines substantially parallel to said principal axis of said groups of products, whereby said bottom connecting wall constitutes a hinge of said two compartments, said two compartments adapted to rotate relative to each other along said two respective one of said creases and said weakening lines from a closed condition wherein said two groups of products are substantially superposed one over the other, with the main top face of said first group of products faced to the main top face of said second group of products, and an open condition wherein said two compartments are separated by said bottom connecting wall and said primary and secondary bottom panels are coplanar to said bottom connecting wall, wherein an internal lateral side of each one of said two compartments, opposite to a corresponding lateral and external containment panel, is open to render easier the extraction of said products from the corresponding compartment when said two compartments are in said open condition.

2. The packet according to claim 1, wherein said at least two compartments are obtained from two blanks, joined to each other by a flap made from one of said two blanks.

3. The packet according to claim 2, wherein a first blank of said two blanks comprises said primary bottom panel, said first lateral and external containment panel, said first bottom containment panel, and said first front containment panel, and wherein a second blank of said two blanks comprises said secondary bottom panel, said second lateral and external containment panel, said second bottom containment panel and said second front containment panel.

4. The packet according to claim 1, wherein at least one group of said two groups of products is comprised of a group of chewing gum sticks.

5. The packet according to claim 4, wherein said chewing gum sticks are wrapped in a primary wrapping.

6. The packet according to claim 4, wherein said group of chewing gum sticks is wrapped in a secondary wrapping.

7. The packet according to claim 1, wherein at least one group of said two groups of products is comprised of at least one instruction leaflet.

8. The packet according to claim 1, wherein at least one group of said two groups of products is comprised of a group of phials.

9. The packet according to claim 1, wherein at least one group of said two groups of products is comprised of a group of flow packs.

10. The packet according to claim 1, wherein at least one group of said two groups of products is comprised of a group of pills contained in a blister pack.

11. The packet according to claim 1, wherein at least one group of said two groups of products comprises a group of products placed side by side along a long edge thereof.

12. The packet according to claim 1, wherein said bottom connecting wall closes laterally both said two compartments when said two compartments are in said closed condition.

13. The packet according to claim 1, wherein at least said primary bottom panel, said secondary bottom panel, said bottom connecting wall, said first lateral and external containment panel, said first bottom containment panel, said first front containment panel, said second lateral and external containment panel, said second bottom containment panel and said second front containment panel are all obtained from a single blank.

14. The packet according to claim 1, wherein said first and second front containment panels are smaller than said primary and secondary bottom panels.

* * * * *